US006619784B2

(12) United States Patent
Bauer

(10) Patent No.: US 6,619,784 B2
(45) Date of Patent: Sep. 16, 2003

(54) SYSTEM AND METHOD FOR REDUCING SERVICE STATION FLUID WASTE AND TO IMPROVE PRINT THROUGHOUT WITH SPIT STRIPS

(75) Inventor: Stephen W. Bauer, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/966,021

(22) Filed: Sep. 28, 2001

(65) Prior Publication Data

US 2003/0063151 A1 Apr. 3, 2003

(51) Int. Cl.[7] ..... B41J 2/165
(52) U.S. Cl. ..... 347/35; 347/23
(58) Field of Search ..... 347/35, 34, 23, 347/7

(56) References Cited

U.S. PATENT DOCUMENTS 6,283,577 B1 * 9/2001 Kosaka et al. ..... 347/35
6,357,854 B1 * 3/2002 Igval et al. ..... 347/36

FOREIGN PATENT DOCUMENTS

EP 0704307 A 4/1996

* cited by examiner

*Primary Examiner*—Shih-wen Hsieh

(57) ABSTRACT

The present invention is embodied in a system and method for implementing spit strips to reduce service station fluid waste, and to improve throughput. The printing system includes a controller, printhead assembly, and a service station assembly, operating to produce an image on a print media. The operations of the system are produced by controlling the direction of a motor. First, a portion of ink in the nozzles that have become dye enriched are determined and then the dye enriched ink is purged on available margins on a periphery of print media outside an area reserved for images.

19 Claims, 6 Drawing Sheets

SYSTEM AND METHOD FOR REDUCING SERVICE STATION FLUID WASTE AND TO IMPROVE PRINT THROUGHOUT WITH SPIT STRIPS

FIELD OF THE INVENTION

The present invention generally relates to inkjet printers and in particular to a system and method for implementing spit strips to reduce service station fluid waste, to improve throughput and to minimize servicing aerosol.

BACKGROUND OF THE INVENTION

Conventional ink jet print engines typically contain three primary components generally organized in series. The platen and the service station are included among these components. The platen has a printing area upon which the print media are printed. The service station includes a spittoon receptacle in which print drops are disposed to clear the nozzles. The service station also contains a wiper to wipe clean the printhead during use and a cap to prevent the printhead from drying out during periods of inactivity.

One common problem that ink jet printers encounter is that the ink nozzles of the ink jet printer frequently become plugged or otherwise contaminated with a variety of contaminants, such as dried ink and paper fibers. These contaminants can crust the nozzle internally and externally, preventing the nozzles from operating correctly and in turn lowering the quality of print on the print media. The service station is used to service a printhead to keep the nozzles operating properly.

A typical function of the service station is capping. Capping prevents the printhead from drying out when not in use. Capping uses a cap to provide a seal between the vaporization chamber and the printhead. Capping prevents ink from being drawn by capillary action from within the ink supply through the printhead. Another function of the service station is known as wiping. This function uses a wiping action to remove external debris and contaminants from the nozzles. Ink used in ink jet printers is designed to dry quickly and permanently, and if allowed to dry on the nozzles and not wiped away becomes difficult to remove.

Ink jet printer service stations may be implemented in a plurality of ways. For instance, one type of service station is a passive service station that does not use a motor. Passive service stations, however, are noisy and not very effective, which can lower print quality and shorten printhead life. Another type of service station design uses a motor to operate the service station and a separate motor to feed paper through the printer. There are several problems, however by using a motor to feed the paper and a motor to operate the service station, the printer will be more costly and heavier.

Other service stations generally include a spittoon receptacle in which print drops are disposed to clear the nozzles. The spittoon is conventionally added to the printer increasing the lateral traverse of the throughput through increased scan width. However, the over travel of this type of service station with the spittoon can be problematic. Another problem is the increase in aerosol accumulation of ink on the printer from particulates that do not have the momentum to reach the spittoons. Also, the concentrated ink from a spittoon can be difficult and time consuming to dispose. Further, in some environments, the spittoon can be considered hazardous waste by regulator standards. Therefore, what is needed is a system and method that solves these problems.

SUMMARY OF THE INVENTION

To overcome the limitations in the prior art described above, and to overcome other limitations that will become apparent upon reading and understanding the present specification, the present invention is embodied in a system and method for implementing spit strips to reduce service station fluid waste, and to improve throughput.

The printing system includes a controller, printhead assembly, and a service station assembly, operating to produce an image on a print media. At the start of a printing operation, a first swath either fires ink into a spittoon and then continues printing the image, or fires ink on a leading edge spit strip. The spit strip can be defined as the height of the printhead divided by number of passes for a given printmode being used. On normal swaths, the printhead can produce an image within the margin of the print image on the print media.

In an alternative embodiment, nozzles not being used to print the image on the particular swath will fire outside the image margins onto spit strips. In another alternative embodiment, additionally, on predetermined swaths, the carriage can revert to a wide traverse and nozzles will eject inks into the spittoons. In another embodiment, since spit strips are used, the printer does not include a spittoon.

The invention maintains image quality on the print media afforded by a spittoon, and with a decrease in the difficulty and time required to dispose of ink from the spittoon as part of the service station system. The invention also decreases the quantity of aerosol accumulation of ink on the printing system. The present invention purges the portion of ink in the nozzles that have become dye enriched. Dye enrichment is caused by the evaporation of ink vehicle through nozzles to create overly concentrated ink, which in turn can cause dark corners on the printed document. This is advantageous because using the dye enriched ink on a portion of a document creates an image quality defect in that portion of the document, which is avoided by the present invention.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

In the following description of the invention, reference is made to the accompanying drawings, which form a part hereof, and in which is shown by way of illustration a specific example in which the invention may be practiced. It is to be understood that other embodiments may be utilized and structural changes may be made without departing from the scope of the present invention.

I. General Overview

Figure 1:
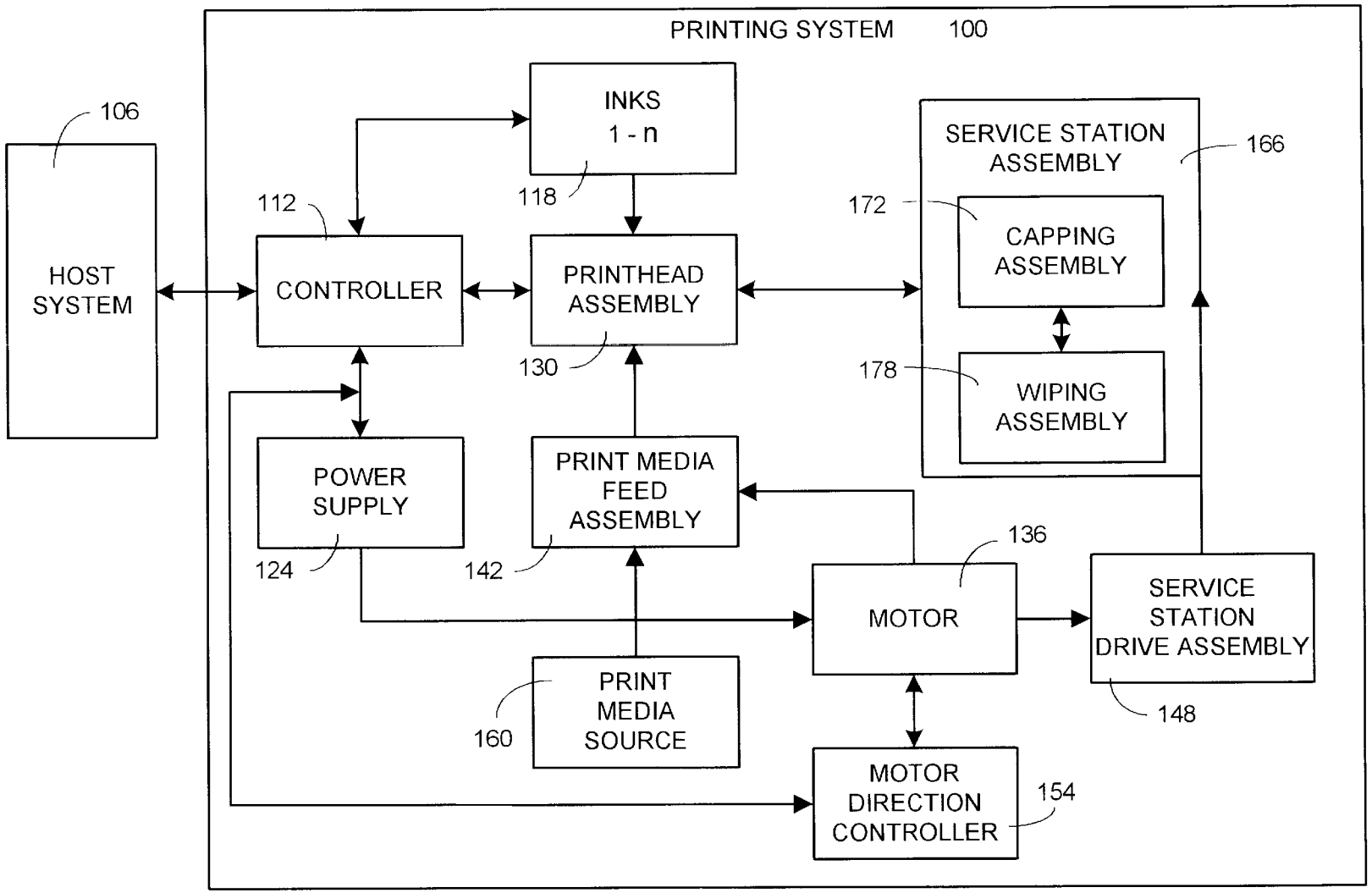
FIG. 1 shows a block diagram of an overall printing system incorporating the present invention.

FIG. 1 is an overall block diagram of overall printing system incorporating the present invention. In general, the printing system 100 can be used for printing a material (such as ink) onto a print media, which can be paper. The printing system 100 is electronically coupled to a host system 106, which can be a computer or microprocessor for producing print data for the printing system 100 to print.

The printing system 100 includes a controller 112 coupled to an ink supply device 118, a power supply 124 and a printhead assembly 130. The printhead assembly 130 generally includes a printhead (not shown) and a carriage assembly (not shown) that allows the printhead to traverse across the print media. The ink supply device 118 is fluidically coupled to the printhead assembly 130. A motor 136, which receives power from the power supply 124, is coupled to a print media feed assembly 142 and a service station drive assembly 148.

Although only one motor 136 is shown, the printing system 100 may include a plurality of other motors that perform various other functions (such as a paper pick-up motor to pick-up paper from a paper storage tray). The direction of the motor 136 is controlled by a motor direction controller 154 that is coupled to the controller 112. A print media source 160 supplies a print media (not shown) to the print media feed assembly 142. A service station assembly 166, can include a capping assembly 172 and a wiping assembly 178, is coupled to the service station drive assembly 148 and interacts with the printhead assembly 130.

The system 100 uses the above described components of FIG. 1 to determine the portion of ink in the nozzles that have become dye enriched and purge this portion on available margins on a periphery of print media outside an area reserved for images. The portion of dye enriched ink can be determined by given parameters, such as with empirical data, with arbitrary estimations or with user configured data. This purging decreases the quantity of aerosol accumulation of ink on the printing system. Dye enrichment is caused by the evaporation of ink vehicle through nozzles to create overly concentrated ink, which in turn can cause dark corners on the printed document. This is advantageous because using the dye enriched ink on a portion of a document creates an image quality defect in that portion of the document, which is avoided by the present invention.

During operation of the printing system 100, the power supply 124 provides a controlled voltage to the controller 112 and the motor 136. The controller 112 receives the print data from the host system 106 and processes the print data into printer control information and image data. The processed data, image data and other static and dynamically generated data are exchanged with the ink supply device 118 and the printhead assembly 130 for controlling the printing system 100.

The printhead assembly 130 receives ink from the ink supply device 118 and prints by ejecting the ink through the printhead assembly 130 onto a print media (such as paper). The print media is supplied by the print media source 160 and transported to the printhead assembly 130 at least in part by the print media feed assembly 142. The motor 136 drives the print media feed assembly 142 and provides a means to transport the print media from the print media source 160 to the printhead assembly 130. The motor 136 also drives the service station drive assembly 148, which provides control of the service station assembly 166 including the capping assembly 172 and the wiping assembly 178. Generally, when the service station drive assembly 148 is engaged with the motor 136, the capping assembly 172 and wiping assembly 178 are active and the service station drive assembly 148 provides precise positioning control to allow the printhead assembly 130 to be capped and wiped. The engagement and disengagement of the motor 136 with the print feed media assembly 142 and the service station drive assembly 148 is achieved in part using the motor direction controller 154.

For example, if the printing system 100 is performing a print media feed operation and the printhead assembly 130 needs service station operations performed, the motor direction controller 154 disengages the print media feed assembly 142 and engages the service station drive assembly 148 by momentarily reversing the direction of the motor 136 (generally less than one full revolution). Similarly, after the service station operations have been performed the motor direction controller 154 disengages the service station drive assembly 148 and engages the print media feed assembly 142 by again momentarily reversing the direction of the motor 136.

Thus, the motor 136 is used both to transport the print media to the printhead assembly 130 and to operate the service station assembly 166 while precisely controlling the positioning of the capping assembly 172 and the wiping assembly 178 relative to the printhead assembly 130. The motor 136 can be used to perform both of these tasks because in general the print media will not be advanced in the printing system 100 while the printhead assembly 130 is being serviced by the service station assembly 166.

II. Exemplary Printing System

Figure 2:
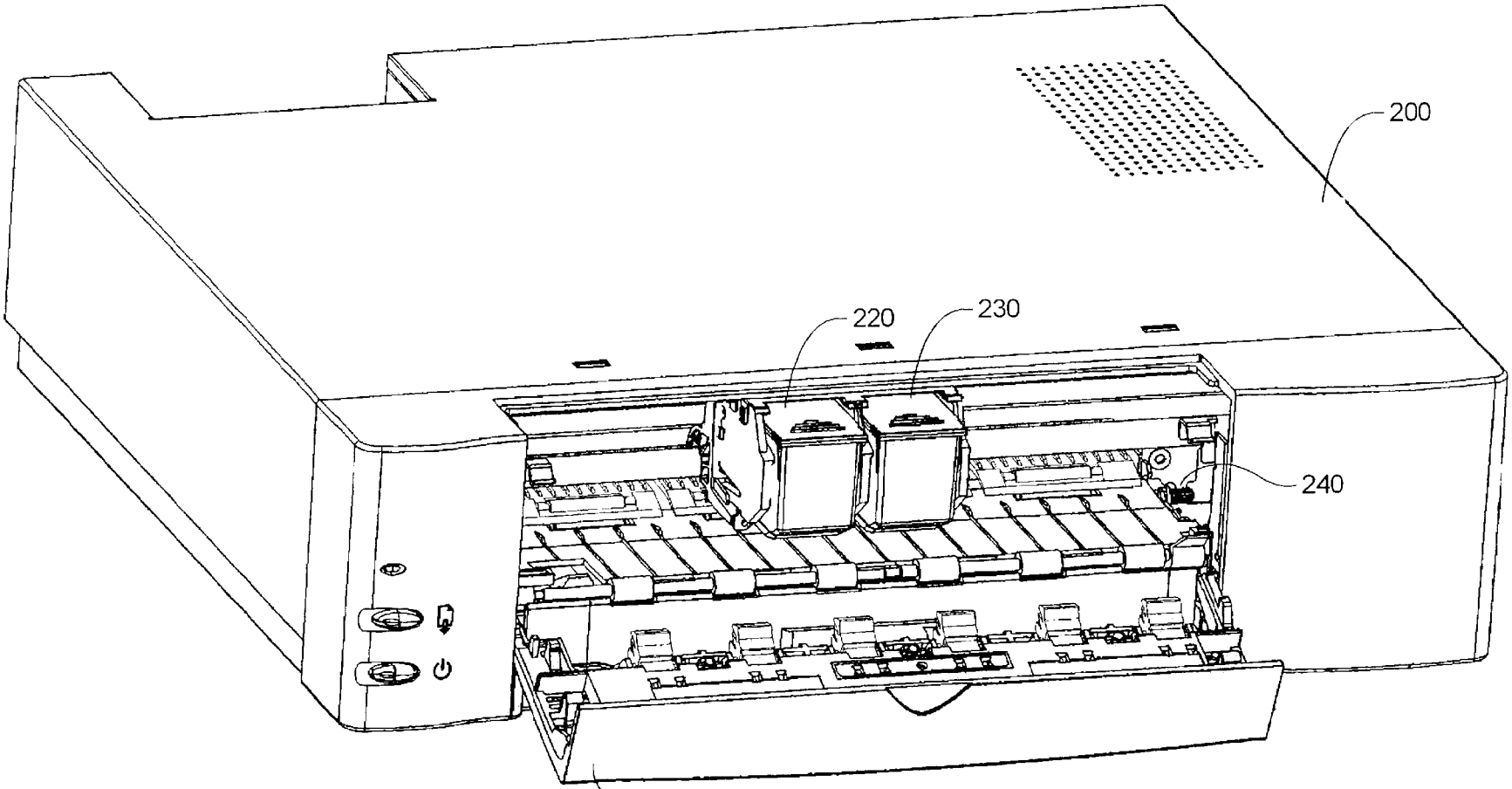
FIG. 2 is an exemplary printing device that incorporates the invention and is shown for illustrative purposes only.

FIG. 2 is an exemplary printing device that incorporates the present invention and is shown for illustrative purposes only. Generally, a printing device 200 includes a door 210 covering an opening of the printing device 200. A first print cartridge 220 and a second print cartridge 230 are designed to install within the printing device 200. Both of the print cartridges 220, 230 are mounted on a carriage assembly (not shown) that provides linear horizontal movement across a print media.

A service station, which is not shown in FIG. 2, attaches at an attachment point 240 at the side of the opening. The service station may be attached using a variety of techniques, such as a spur gear. When the service station is attached to the printing device 200 at the attachment point 240, the service station is able to provide service station operations to the first print cartridge 220 and the second print cartridge 230.

III. Details of the Components and Operation

Figure 3:
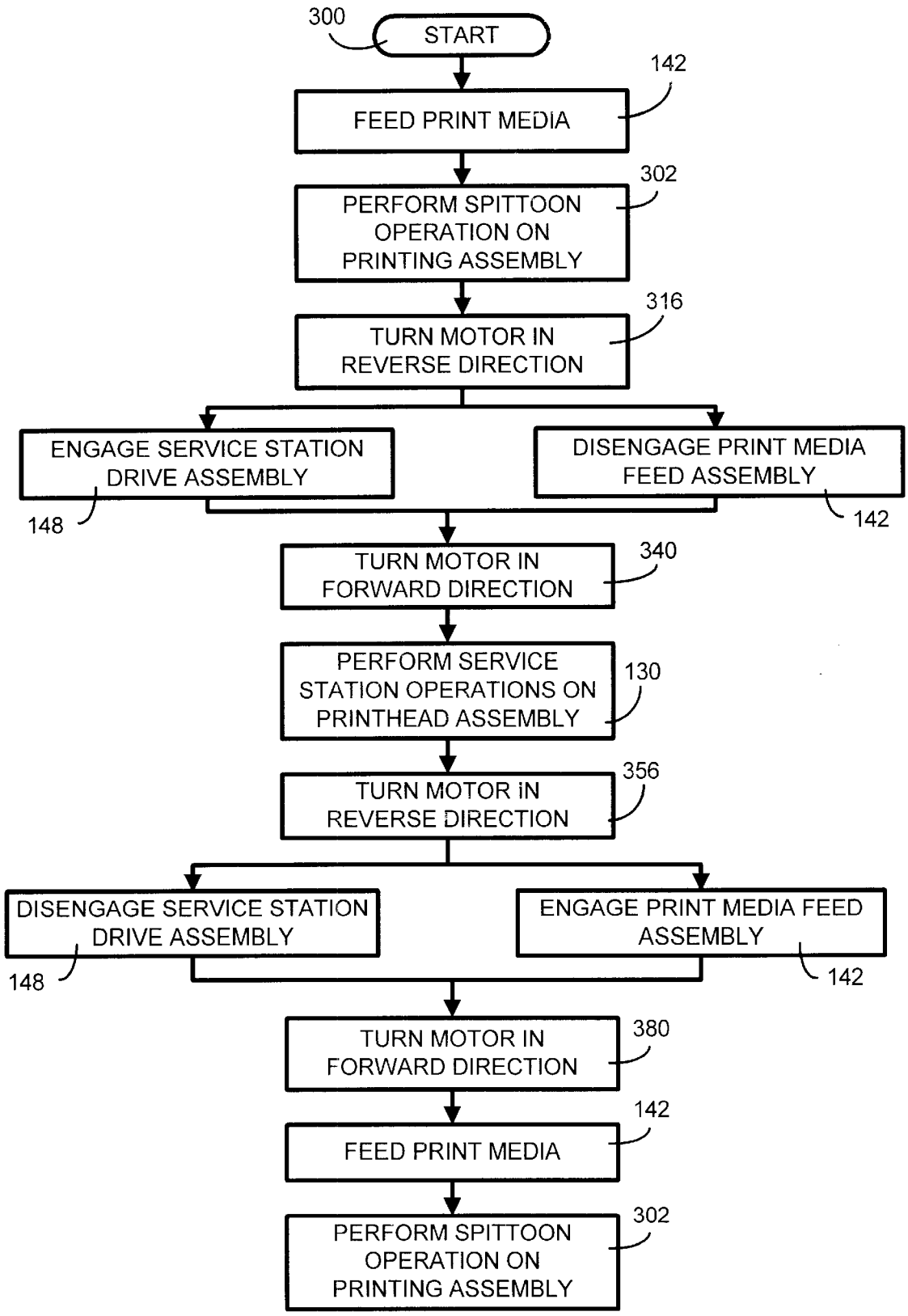
FIG. 3 is a detailed flow diagram illustrating the operation of the present invention.

FIG. 3 is an overview flow diagram of the general operation of the present invention. In general, the present invention begins with a print media operation, and is part of a cycle that completes that operation and momentarily reverse the motor direction, begins a service station operation, completes that operation and momentarily reverses the motor direction, and begins the cycle again.

The cycle starts 300 and the print media is fed by the motor 136 to the printhead assembly 130. The printhead assembly then operates a wide swath so that inks 1–n are ejected into the spittoon 302. At this point, the motor 136 is engaged with the print media feed assembly 142 and disengaged from the service station drive assembly 148. As explained in detail below, the motor 136 is then turned momentarily in the reverse direction 316 so as to engage the service station drive assembly 148 and disengage the print media feed assembly 142. After the engagement of the service station drive assembly 148 and the disengagement of the print media feed assembly 142 the motor 136 is turned in the forward direction 340.

Once the service station drive assembly 148 is engaged With the motor 136 service station operations may be performed on the printhead assembly 130. These service station operations include, for example, capping, wiping and priming operations. Once the service station assembly 166 has performed the desired servicing of the printhead assembly 130 the motor 136 is momentarily turned in the reverse direction 356. This action disengages the service station drive assembly 148 and engages the print media feed assembly 142. The motor 136 is then turned in the forward direction 380 and the print media is fed by the print media feed assembly 142 to the printhead assembly 130.

Figure 4:
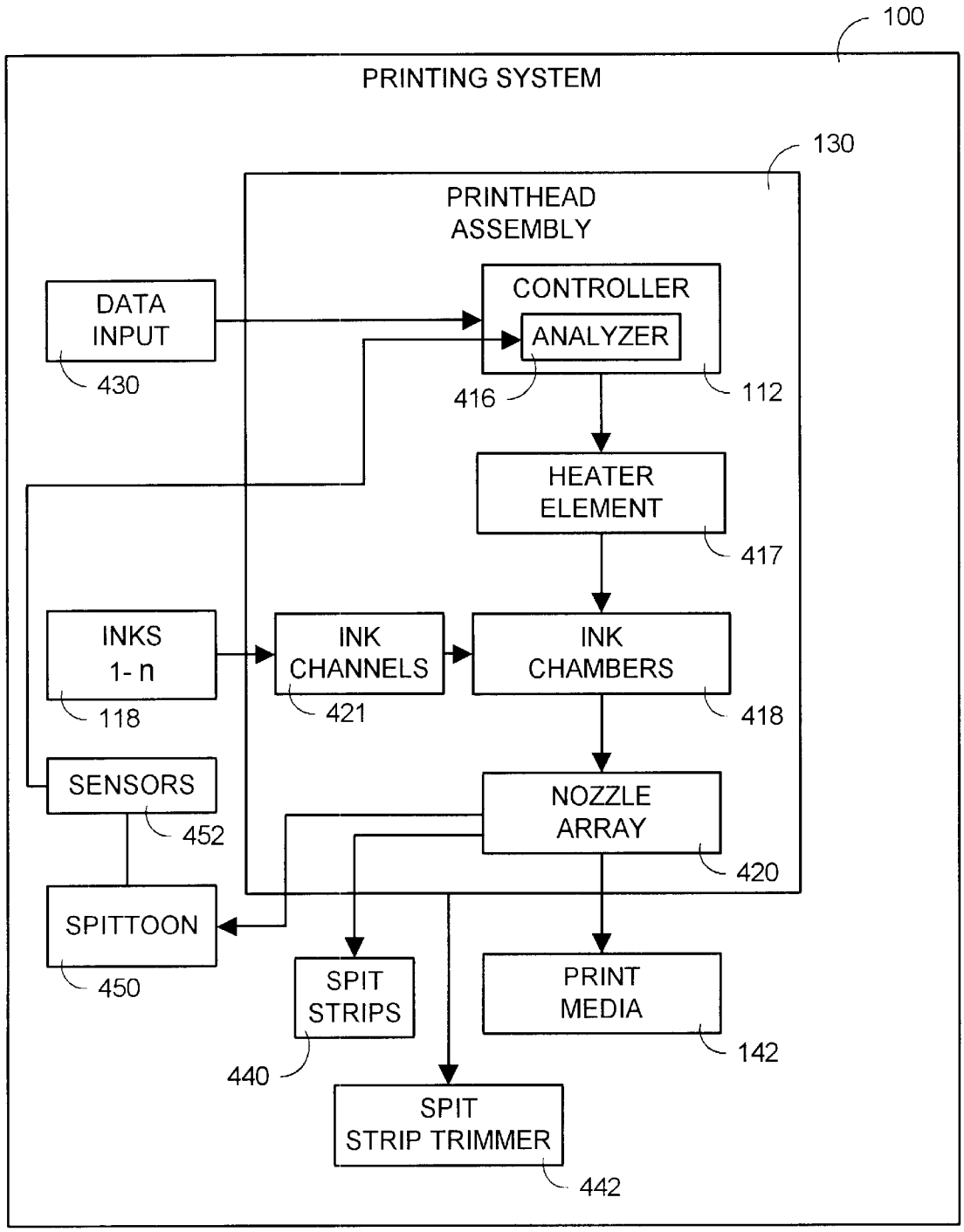
FIG. 4 is a block diagram illustrating the relationship between print swaths and the printhead assembly.

FIG. 4 shows a block diagram of an overall printing system incorporating the present invention. The printing system 100 of the present invention includes a printhead assembly 130, an inks 1–n 118 and print media 142. The printhead assembly 130 includes a controller 112, heater elements 417, ink chambers 418 with orifices or nozzles 420 fluidically coupled to associated ink channels 421.

During a printing operation, inks 1–n 118 through the ink channels 421 supply ink to an interior portion (such as an ink reservoir) of the printhead assembly 130. The interior portion of the printhead assembly 130 provides ink to the ink chambers 418 for allowing ejection of ink through adjacent nozzles 420. The printhead assembly 130 receives commands from a controller 112 to print ink and form a desired pattern for generating text and images on the print media 142. Print quality of the desired pattern is dependent on the formation of ink droplets uncontaminated by such factors as dye enrichment or ink plugs.

Ways to maintain print quality include the incorporation of a service station 166 to cap 172 and wipe 178 the printhead, and to prevent the development of an ink plug. The nozzles 420 can be cleared by ejecting ink into a spittoon 450 placed at a wider scan width. In a preferred embodiment of the current invention, nozzles would be cleared by ejecting inks 1–n 118 on spit strips 440 on available margins on the periphery of the print media 142. The printhead assembly 130 traverses along the carriage of the printer a set distance to print on the print media 142, and a further set distance to eject inks 1–n 118 from nozzles not currently printing ink to the print media 142 on to the spit strips 440. This action prevents the development of ink plugs on the nozzle array 420. These spit strips 440 would be trimmed from the print media by the spit strip trimmer 442 during the feed print media 142.

In addition, the printhead 130 has been programmed to traverse a further distance to the spittoon 450 at the start of a printing operation and at specific moments during the printing operation. The controller 112 contains an analyzer 416 that receives information from the sensors 452 located in the spittoon 450. By controlling the number of times inks are ejected into the spittoon, the amount of aerosol contamination in the printing system 100 is decreased. In an alternative embodiment, the spittoon 450 is not needed and not used, since the spit strips are used. As such, disposal of the ink in the spittoon would be avoided, which may be considered hazardous waste disposal by some regulatory governing bodies.

Figure 5:
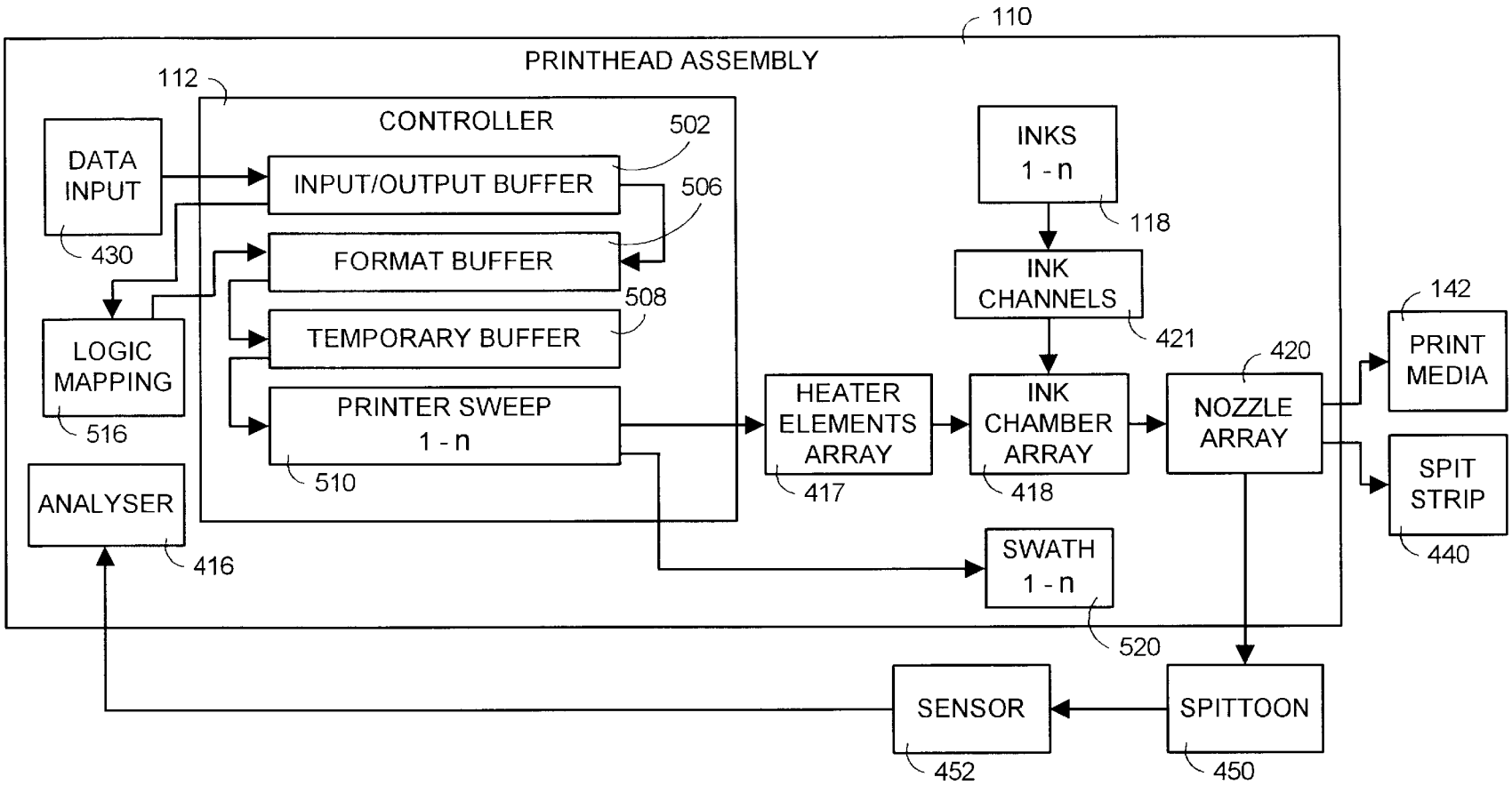
FIG. 5 is a block diagram illustrating the interaction between the components of the controller and the print swaths of the printing system.

FIG. 5 is a block diagram of the printhead assembly incorporating features of the present invention. The controller 112 contains the input output buffer 502, the logic mapping system 516, the format buffer 506, temporary buffer 508, and the printer sweep 1–n 510. When data enters the system from the data input 430 it is held in the input/output buffer 502 of the controller 116 while the logic mapping system 516 analyzes the data.

After the logic mapping system 516 has assigned pixel locations for the data these locations are transferred to the format buffer 506 for the formation of rasters. The data are then held in a temporary buffer 508 while the printer sweep 1–n 510 formats the data for the print cartridges. These data are relayed to the heater elements 417 which cause the heating of the ink chamber 418 and the ejection of ink from the nozzle array 420 to the print media 142, the spit strip 440, and as programmed, to the spittoon 450. In the same time frame the printer sweep 1–n 510 communicates with the swath 1–n system 520 so that the width of the swath will match the data of the nozzle array 420.

Sensors 452 in the spittoon 450 transfer data to the analyzer 416. Data from the analyzer 416 are integrated with data from the input/output buffer in the logic mapping system 516. These data are incorporated in the subsequent formats as required.

IV. Working Example

Figure 6:
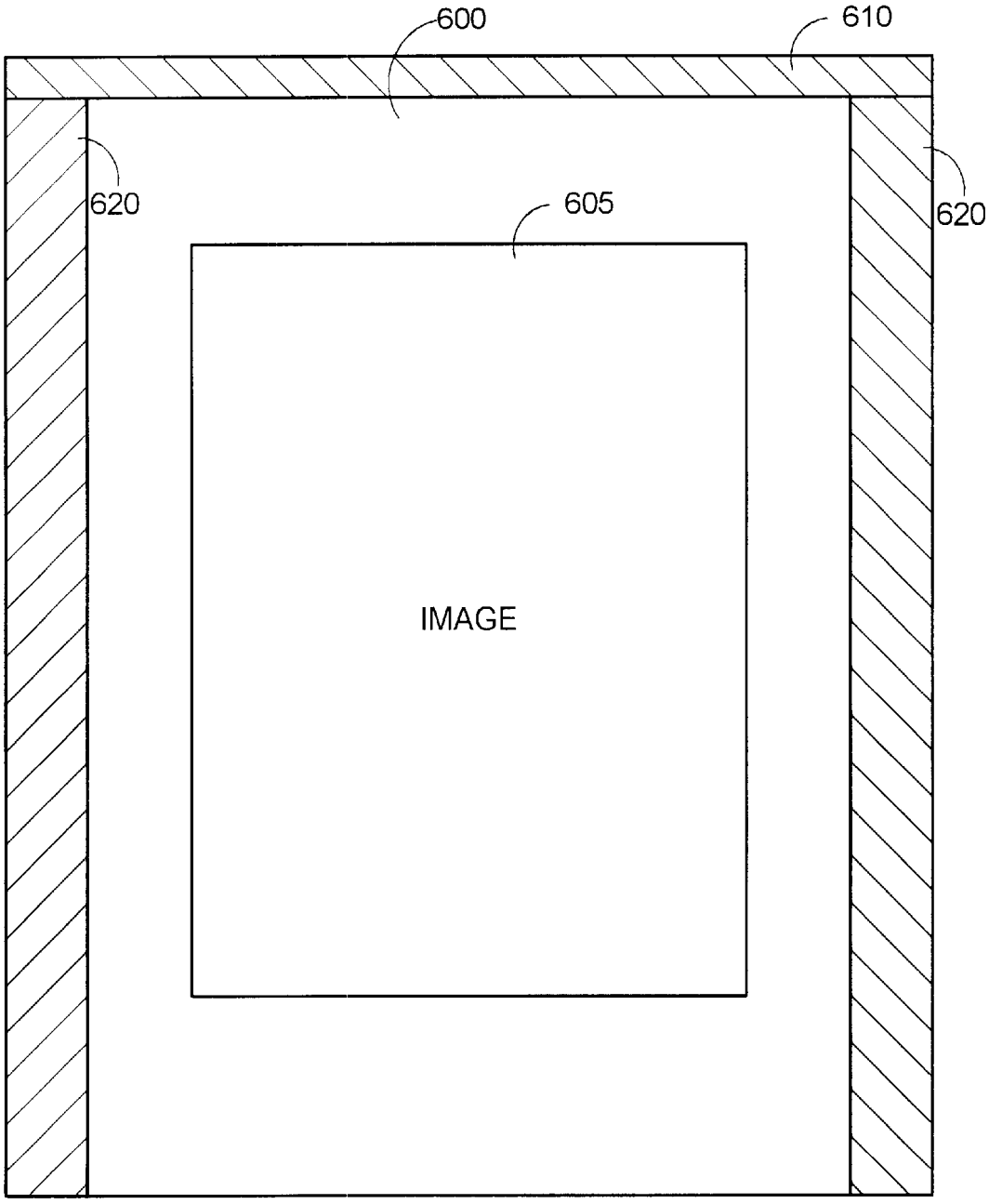
FIG. 6 is a pictorial diagram illustrating the spit strips disposed on print media with an image.

FIG. 6 is a pictorial diagram illustrating the spit strips disposed on print media with an image and is shown for illustrative purposes only. Referring to FIG. 6 along with FIGS. 1–5, print media 600, which can be any suitable media, such as a standard 8½"×11" sheet of paper or a special continuous roll of photo paper, includes an image 605 that is printed on it. Spit strip 610, preferably along the top margin, and spit strips 620, preferably along the side margins, can be printed within the margins and outside the image 605. The spit strip size could be any size suitable to keep the nozzles in working order and to prevent dye enrichment, while not wasting ink. In this example, spit strip 610 is approximately 0.125 inches wide and spit strips 620 are approximately 0.25 inches wide.

In addition, preferably, the print media 600 is cropped to enable discarding of the spit strips 610 and 620. Alternatively, the print media 600 can have perforated edges along the margins to allow removal of the spit strips 610 and 620. It should be noted that FIG. 6 shows the spit strips 610 and 620 at the edge of the print media 600 for illustrative purposes only. Depending on how the margins are configured with the printer, the spit strips 620 can be printed anywhere suitable within the margins and not on the image 605.

The spit strips decrease the quantity of aerosol accumulation of ink on the printing system. Also, it purges, outside the image, a portion of the ink in the nozzles that have become dye enriched. This is advantageous because using the dye enriched ink on a portion of the image creates quality defects.

The description of the present invention has been presented for purposes of illustration and description, but is not intended to be exhaustive or limited to the invention in the form disclosed. Many modifications and variations will be apparent to those of ordinary skill in the art. Therefore, the foregoing description should not be taken as limiting the scope of the invention defined by the appended claims.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method in a printer for reducing service station ink waste, the printer having a nozzle member with a plurality of ink ejection nozzles that ejects ink across print swaths on a print media, the method, comprising:

determining a portion of ink in the nozzles that have become dye enriched ink;

purging the dye enriched ink on available margins on a periphery of print media outside an area where image data is printed; and instructing the nozzle member to vary the width of traversal across certain predefined print swaths when printing the ink.

2. The method of claim 1, wherein purging the dye enriched ink includes printing the dye enriched ink onto spit strips of the print media.

3. The method of claim 2, further comprising trimming the spit strips with a spit strip trimmer during feeding of the print media of a print cycle.

4. The method of claim 1, further comprising traversing the nozzle member along a carriage connected to the nozzle member.

5. The method of claim 1, further comprising providing perforations between margins of the print media and a printable image area.

6. The method of claim 1, further comprising eliminating use of a spittoon in the printer.

7. The method of claim 1, further comprising decreasing the quantity of aerosol accumulation of ink on the printer.

8. A printing system receiving input data for printing images on print media, comprising:

a nozzle member for ejecting ink;

a service station coupled to the nozzle member, which is used to purge dye enriched ink on available margins on a periphery of the print media outside an area where images are printed; and a controller that instructs the nozzle member to traverse various widths in various swaths.

9. The printing system of claim 8, wherein ink is ejected onto the print media as a printed image within the margins of the print media, and the purging of the dye enriched ink includes ejecting ink on lateral margins from nozzles not currently printing the printed image.

10. The printing system of claim 8, wherein purging of the dye enriched ink includes producing spit strips.

11. The printing system of claim 8, wherein a wide swath of ink is produced by the nozzle member and ink is ejected ink into a spittoon.

12. The printing system of claim 11, wherein ink in the spittoon is sensed by ink sensors.

13. The printing system of claim 12, wherein the ink sensors relay data to an analyzer for producing ink data that affects formatting of subsequent printing sweeps of the nozzle member.

14. The printing system of claim 8, wherein a spittoon is not used by the service station.

15. An ink jet printhead for printing images on print media, comprising:

a processor coupled to a controller that provides access to first and second sets of data; and a nozzle member that ejects ink for printing images based on the first set of data and for purging dye enriched ink on available margins on a periphery of the print media outside an area where images are printed based on the second set of data, and wherein a controller that instructs the nozzle member traverses various widths in various swaths.

16. The ink jet printhead of claim 15, wherein purging the dye enriched ink includes printing spit strips.

17. The ink jet printhead of claim 15, further comprising a trimmer that trims the spit strips during feeding of the print media of a print cycle.

18. The printhead of claim 15, wherein a spittoon is not used by the ink jet printhead.

19. The printhead of claim 15, wherein the first set of data includes printer driver information for printing an image instructed by a user and the second set of data includes predefined empirical parameters including the size of the spit strips and the amount of ink purged.

* * * * *